US011435115B2

(12) United States Patent
Jensen

(10) Patent No.: US 11,435,115 B2
(45) Date of Patent: Sep. 6, 2022

(54) TWISTED CONDUIT FOR GEOTHERMAL HEAT EXCHANGE

(71) Applicant: Robert Jensen, Montvale, NJ (US)

(72) Inventor: Robert Jensen, Montvale, NJ (US)

( * ) Notice: Subject to any disclaimer, the term of this patent is extended or adjusted under 35 U.S.C. 154(b) by 0 days.

(21) Appl. No.: 16/818,919

(22) Filed: Mar. 13, 2020

(65) Prior Publication Data

US 2021/0285724 A1 Sep. 16, 2021

(51) Int. Cl.

| | |
|---|---|
| ***F24T 10/15*** | (2018.01) |
| ***F24T 10/17*** | (2018.01) |
| *F28D 1/047* | (2006.01) |
| *F24T 10/00* | (2018.01) |

(52) U.S. Cl.

CPC ..... *F24T 10/15* (2018.05); *F24T 10/17* (2018.05); *F24T 2010/50* (2018.05); *F28D 1/0472* (2013.01); *F28D 1/0475* (2013.01); *F28F 2210/02* (2013.01)

(58) Field of Classification Search

CPC ..... F24T 10/15; F24T 10/17; F24T 2010/50
USPC ..... 165/45
See application file for complete search history.

(56) References Cited

U.S. PATENT DOCUMENTS

2012/0186776 A1* 7/2012 Jensen ..... F16L 3/223 165/45
2012/0193069 A1* 8/2012 Jensen ..... F16L 9/19 165/45
2014/0262136 A1* 9/2014 Jensen ..... F24T 10/15 165/45

FOREIGN PATENT DOCUMENTS

DE 102012103499 A1 * 10/2013 ..... F24T 10/15
JP 2016223633 A * 12/2016 ..... F24T 10/15

* cited by examiner

*Primary Examiner* — Devon Russell
(74) *Attorney, Agent, or Firm* — Harold G. Furlow, Esq.

(57) ABSTRACT

A geothermal heat exchange apparatus is disclosed that includes a central conduit, a plurality of pipes, at least one fitting and a joint. The geothermal heat exchange apparatus is preassembled for insertion into a bore hole and for connection to a supply primary pipe and a return primary pipe that are in fluid communication with a heat pump. The geothermal heat exchange apparatus includes the plurality of pipes in a helical arrangement around the central conduit for geothermal heat exchange. The at least one fitting is fixedly connected to a first end portion of the central conduit in the bore hole.

10 Claims, 9 Drawing Sheets

TWISTED CONDUIT FOR GEOTHERMAL HEAT EXCHANGE

BACKGROUND OF THE INVENTION

Field of the Invention

The present disclosures relates to the arrangement of pipes for a geothermal heat exchange apparatus and in particular to a geothermal heat exchange system that includes a plurality of heat exchange pipes positioned in a helical configuration around a central conduit, the plurality of pipes connect to at least one fitting and the at least one fitting positioned in the bore hole with the plurality of pipes and central conduit, the at least one fitting connecting to primary pipes that are sources of supply and return of the heat exchange fluid for the geothermal heat exchange apparatus.

Description of the Related Art

There is a broad array of configurations for the exchange of heat between a structure and a geothermal heat exchanger. FIG. 1 shows one example of a prior art geothermal environmental conditioning system 1. As defined herein, geothermal environmental conditioning system 1 is a heating system and/or a heating and cooling system. The geothermal environmental conditioning system 1 or geothermal system 1 as defined herein includes a structure 2 that is in fluid communication with a heat pump 3 or other similar device that circulates the fluid in primary pipe 4 that are identified as supply pipe 4A and primary return pipe 4B. Supply pipe 4A and return pipe 4B are positioned below grade level 5 on a floor of a trench 6. The floor of trench 6 is below the frost line depth. A plurality of heat exchange pipes 7 are located in a bore hole 8 and extend out of bore hole 8 into trench 6. A prior art connector 9 is connected to each pipe of the plurality of pipes 7 and to supply pipe 4A and/or return pipe 4B that interface with heat pump 3. The prior art connector 9 has a the overall shape of a fan with an array of diverging pipes from a single source all aligned in a single plane. The geothermal system 1 defines a closed loop fluid heat exchange system between structure 2, heat pump 3, supply pipe 4A, heat exchange pipe 7 and return pipe 4B. The earth surrounding heat exchange pipe 7 or pipe 7 that is in bore hole 8 below the frost line depth and provides a stabilized thermal baseline for the exchange of heat compared to the above ground ambient environment. Pipes 7 can be positioned on a horizontal floor of trench 6 that is well below frost line depth or in a bore hole 8 that can extend hundreds of feet into the earth.

Geothermal systems 1 are particularly known for their superior performance in delivering energy conserving heating and/or cooling to homes, commercial businesses and industrial buildings in many climates when they can have extended lengths of pipe 7 for the enhanced exchange of heat. Geothermal systems designs can include singular extended lengths of pipe 7 for heat exchange as well as prior art manifold type connectors 9 that divide the heat exchange flow into multiple pipes 7 each with a separate angular alignment. For one example, geothermal systems 1 can include prior art connector 9 that interfaces with supply pipe 4A or another portion of pipe 7 on one end and divides the heat exchange fluid flow into multiple angularly diverging pipes 7 in the opposed end for the improved heat exchange performance of geothermal system 1. A second prior art connector 9 connects to each pipe 7 and converges the heat exchange fluid flow from the multiple pipes 7 into single return pipe 4B. See U.S. Pat. No. 9,127,858 to McKeown et al.

In contrast, prior art geothermal system 1 is a compact helical arrangement of pipes 7 and the use of prior art connector 9 with its wide diverging alignment of pipes 7 is difficult to work on and to connect the diverging alignment of pipes 7 in the bottom of a confined five (5) foot deep trench. This makes for an unnecessarily complex, time consuming and thereby expensive connection between pipes 7 and prior art connector 9 when there are no other manifold type prior art connector 9 options available for geothermal system 1 applications.

Both of the above approaches have been limited by the (1) increased cost of performing a sizable number of connections between pipes 7 and other pipes 7 and/or between pipes 7 and connectors 9 (or "pipe 7 connections") under field conditions, (2) reduced reliability of making pipe 7 connections under field environment conditions such as those inside a five foot deep trench, (3) the prior art connector 9 diverging alignment requires unwinding and separating individual pipes 7 from their helical arrangement for an alignment with the diverging arrangement of prior art connector 9 making an overly complicated and time consuming pipe 7 connections in the field environment, (4) the increased likelihood of field pipe 7 connection errors which can result in the erroneous routing of the heat exchange fluid through multiple pipes 7 and decreased performance of geothermal system 1. Thus, there is an inherent desire to improve the overall reliability and performance of geothermal systems 1 by moving as much of the pipe 7 connections as possible into the factory and away from the additional expenses and reduced reliability associated with field connections of pipe 7.

Pipe 7 connections under factory environmentally controlled conditions whether between various types of connectors 9 such as U-Bend and/or manifold connectors produce more reliable connections, can be more readily tested and as required economically repaired prior to arrival in the field for installation.

Another added expense of geothermal systems 1 is the length of the trenches 6 that are required to be dug for horizontal systems and the transportation of the pipes 7 to the installation site. Pipes 7 can include straight, semi-rigid and/or rigid pipes that have multiple limitations that include the transportation of long sections of pipe 7 and the manual labor required to unload, position and connect the multiple extended length of pipes 7.

The ideal geothermal system 1 is one that is produced in a factory environment for the reliability of the connections, is sufficiently flexible that it can be coiled into a compact arrangement for transportation and can be installed on site with a minimal number of pipe 7 connections in the field.

A new compact manifold connector 9 is needed for a compact helical arrangement of pipes 7 that does not diverge pipes 7 on different angles and combines the heat exchange flow of multiple pipes 7 in a bore hole 8 in a singular alignment with central conduit for connection to a larger diameter supply pipe 4A and/or return pipe 4B.

Heretofore there has not been a high efficiency compact and flexible arrangement of multiple pipes 7 for geothermal heat exchange that has been assembled in the factory, can be coiled for ease of transportation, uncoiled on site, installed pre-assembled into a bore hole, with at least one fitting connected to a plurality of pipes and to lengths of primary pipes 4 and connected to the central conduit below grade in the bore hole, the fitting having a dimensional fit and form design for positioning in the borehole and the lengths of the primary pipes 4 extending from the borehole for connection directly to supply pipe 4A and return pipe 4B for geothermal heat exchange.

SUMMARY OF THE INVENTION

The present disclosure is a novel structure of a geothermal heat exchange apparatus wherein the geothermal heat exchange apparatus is preassembled in a factory for installation into a bore hole and connection with the primary pipe for supply and the primary pipe for return of the heat exchange fluid. Specifically, the geothermal heat exchange apparatus includes the twisting of a plurality of pipes onto a central conduit and the connection of manifold fittings to the plurality of pipes in a compact minimum diameter form that can be inserted into a borehole. It is understood that while it is preferred to minimize the diameter of the borehole, there are applications in which the minimum diameter borehole is not necessarily the most desired or preferred approach for heat exchange. It can also be desirable to drill the borehole to a desired diameter vice the minimum diameter for the installation of the compact geothermal heat exchange apparatus. The pre-assembled structure of the geothermal heat exchange apparatus makes more efficient use of the borehole space by placing more pipe and at least one manifold fitting into the borehole in a compact spaced arrangement for heat transfer. The unique structural arrangement of the geothermal heat exchange apparatus creates additional surface area for heat transfer surface through flexible thin walled pipes in a small diameter borehole. The twisted plurality of pipes is wrapped in helical arrangement that is in contact with the central conduit such that the interface between the plurality of pipes and the central conduit bind the plurality of pipes into a fixed position on the central conduit. In addition, bands or straps can be used to further connect the plurality of pipes on the central conduit. This structural arrangement also provides support for retaining the relative position of each pipe during installation in a relatively tight borehole. The flexible nature of the central conduit and the plurality of pipes in a twisted arrangement is easily coiled and transported in a roll to a job site.

An arrangement of flexible pipes for geothermal heat exchange is described that comprises a central conduit and a plurality of pipes. The central conduit has a tubular structure that includes a first end portion and an opposed second end portion. The central conduit defines an aperture in the first end portion that is aligned with the longitudinal axis of the central conduit and extends the first end portion and the second end portion.

Each pipe of the plurality of pipes has a first end portion and an opposed second end portion. Each pipe has a tubular structure that preferably has a circular cross-section. The plurality of pipes is twisted around the central conduit in an approximately parallel arrangement and in an approximately fixed spaced separation that defines a gap between adjacent pipes. Each pipe of the plurality of pipes is positioned in direct contact with the central conduit. The second end portion of each pipe of the plurality of pipes is connected to a joint. The joint receives and redirects the flow from at least two supply pipes of the plurality of pipes to at least two return pipes of the plurality of pipes. The geothermal heat exchange apparatus is flexible and coilable into a roll. The first end portion of each pipe of the plurality of pipes is adapted to connect to the at least one fitting and the at least one fitting connects through the primary pipes to an external environmental control system for the transfer of a liquid that is a heat exchange medium through the plurality of pipes. The plurality of pipes provides an extended arcuate pathway for the exchange of heat between the liquid and the earth. The external environmental control system at least includes heating and/or cooling.

The geothermal heat exchange apparatus is structured and pre-assembled for installation in a borehole. The geothermal heat exchange apparatus or apparatus includes a pre-assembled plurality of pipes in a twisted arrangement around a central conduit for geothermal heat exchange and connection to the primary pipes that provide fluid flow to the heat pump. The apparatus comprises a central conduit, a plurality of pipes, at least one fitting and a joint. The central conduit or conduit has a first diameter, a first end portion that includes a first terminal end, a second end portion that is opposed to the first end portion and includes a second terminal end. The central conduit includes a center portion of that is continuous with and in fluid communication with the first end portion and the second end portion. The first end portion, central portion and second end portion define a through aperture that extends the length between the first terminal end and the second terminal end. The central conduit is flexible.

Each pipe of the plurality of pipes has a first end portion, a center portion and an opposed second end portion. The first end portion is aligned with the central conduit and includes a first terminal end. The center portion is in direct contact with and has a helical arrangement around the central conduit. The center portion of the plurality of pipes is in fluid communication with the first end portion and the second end portion of the plurality of pipes. The second end portion of the plurality of pipes is aligned with the central conduit and includes a second terminal end. Each pipe defines an aperture that extends the length between the first terminal end and the second terminal end of the pipe. Each pipe of the plurality of pipes is flexible. The plurality of pipes are positioned in and fixed in direct contact with the central conduit. The plurality of pipes are bound to the central conduit by the helical arrangement. Bands can be used to further fix and bind the plurality of pipes to the central conduit. The plurality of pipes include at least two pipes that are supply pipes and at least two pipes that are return pipes. Each pipe of the plurality of pipes has a second diameter that is less than the first diameter. The first end portion of each pipe of the plurality of pipes is connected to one fitting and the second end portion of each pipe of the plurality of pipes is connected to the joint.

The at least one fitting is a manifold connector. Each fitting has a first end portion that includes a first aperture and an opposed second end portion that includes at least two second apertures. The first aperture connects to a primary pipe and the at least two second apertures connect to at least two pipes of the plurality of pipes. The first aperture has a straight alignment and is in fluid communication with the first end portions of the at least two pipes. The at least two second apertures and first aperture of the at least one fitting and the second end portion of the at least two primary pipes connect in the first straight alignment. The first straight alignment is aligned with the central conduit. The at least one fitting is in direct contact with, connected to and is fixed in position on the first end portion of the central conduit. The first end portion of the central conduit extends beyond the at least one fitting.

The joint as defined herein can include one or more sub-assemblies such as fittings, connectors and U-bends. The joint includes a first end portion and an opposing second end portion. The first end portion of the joint connects to the second end portion of the plurality of pipes. The joint provides fluid communication from the at least two pipes that are supply pipes of the plurality of pipes to at least two pipes that are return pipes of the plurality of pipes.

The at least one fitting of the apparatus can include two fittings. In this preferred embodiment, each fitting is an identical manifold connector. Each fitting has a first terminal end and an opposed and aligned second terminal end. The first terminal ends of the fittings connect to one of the supply or return primary pipes and the second terminal ends of the fittings connect to the second terminal ends of at least two of the plurality of pipes that are supply pipes and at least two of the plurality of pipes that are return pipes.

Alternatively, the at least one fitting can be a single manifold connector. The single fitting embodiment is in fluid communication with one primary pipe that is a supply pipe and one primary pipe that is a return pipe. The fitting is also in fluid communication with at least two pipes of the plurality of pipes that are supply pipes and at least two pipes of the plurality of pipes that are return pipes. The single fitting is configured for connection to the first end portion of the central conduit and positioning in the bore hole.

The joint in one embodiment includes two fittings. A second terminal end of the first fitting connects to the at least two pipes of the plurality of pipes that are supply pipes and a second terminal end of the second fitting connects to at least two pipes of the plurality of pipes that are return pipes. A first terminal end of each fitting connects to one of the terminal ends of a U-bend. The U-bend connects the plurality of pipes that are supply pipes to the plurality of pipes that are return pipes.

The joint in another embodiment includes at least two fittings. The second end portions of the fittings connect to at least two pipes of the plurality of pipes that are supply pipes and at least two pipes of the plurality of pipes that are return pipes. The first end portions of the fittings are capped to terminate the fluid flow through the first aperture and redirect the fluid flow between the two pairs of at least two pipes of the plurality of pipes.

The joint with at least two fittings can include the positioning of each fitting in a staggered arrangement along the central axis of the apparatus or in a tandem arrangement on opposing sides of the central axis of the apparatus.

The joint can also be a manifold connector that includes a first end portion and an opposed second end portion. The first end portion connects to and is in fluid communication with the second terminal ends of the plurality of pipes. The second end portion includes a reservoir that is in fluid communication with at least two pipes that are supply pipes and at least pipes that are return pipes. The arrangement of the joint as a single assembly that includes a common reservoir simplifies the assembly of the apparatus because the reservoir is common to the supply inputs and return outputs of the plurality of pipes and individual pipes cannot be incorrectly connected to the joint.

DETAILED DESCRIPTION OF THE INVENTION

Figure 1:
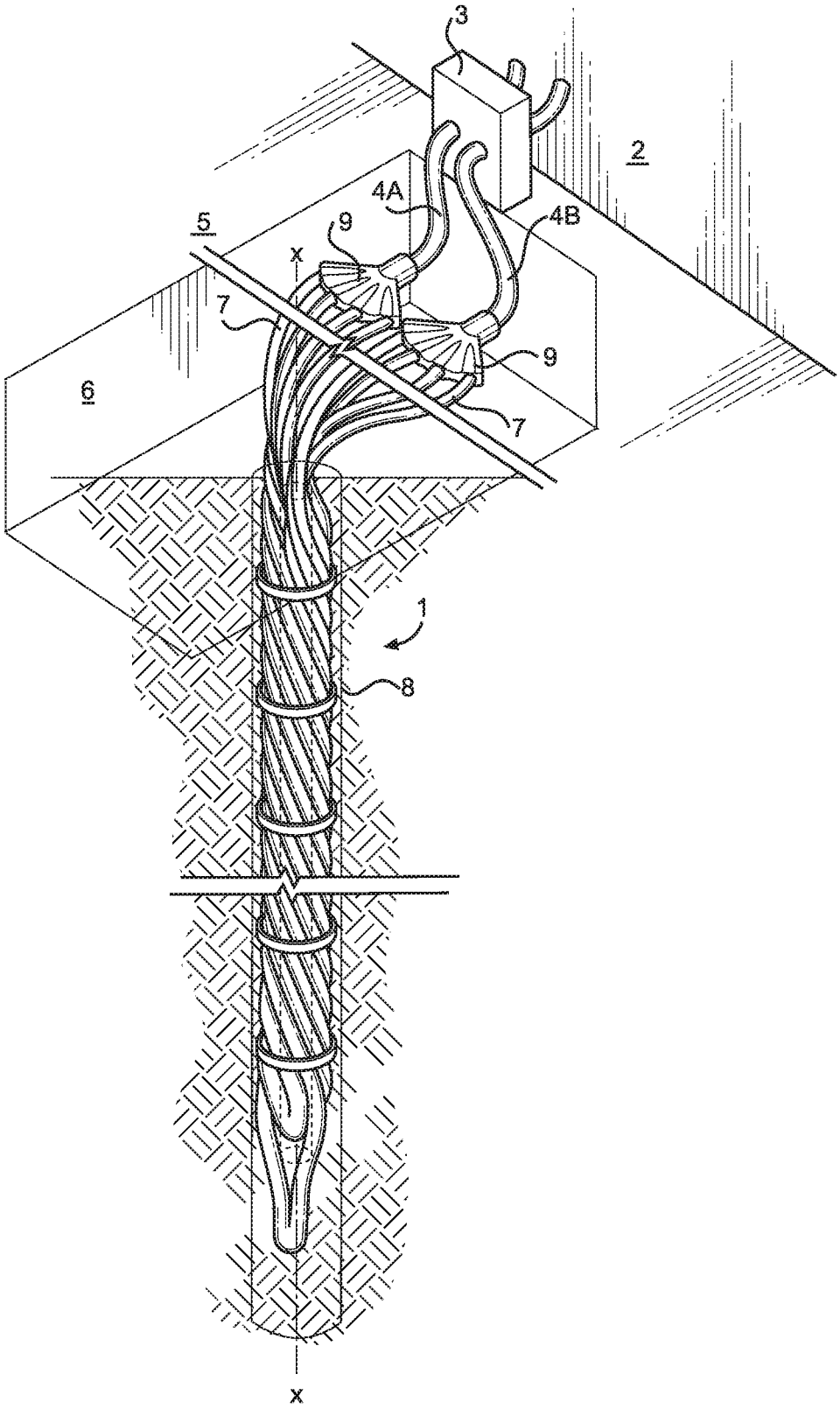
FIG. 1 (PRIOR ART)
FIG. 1 is a perspective view of an idealized prior art environmental control system that uses a helical arrangement of a plurality of pipes and a prior art connector in a trench for connection to the primary pipes for geothermal heat exchange.
Figure 2:
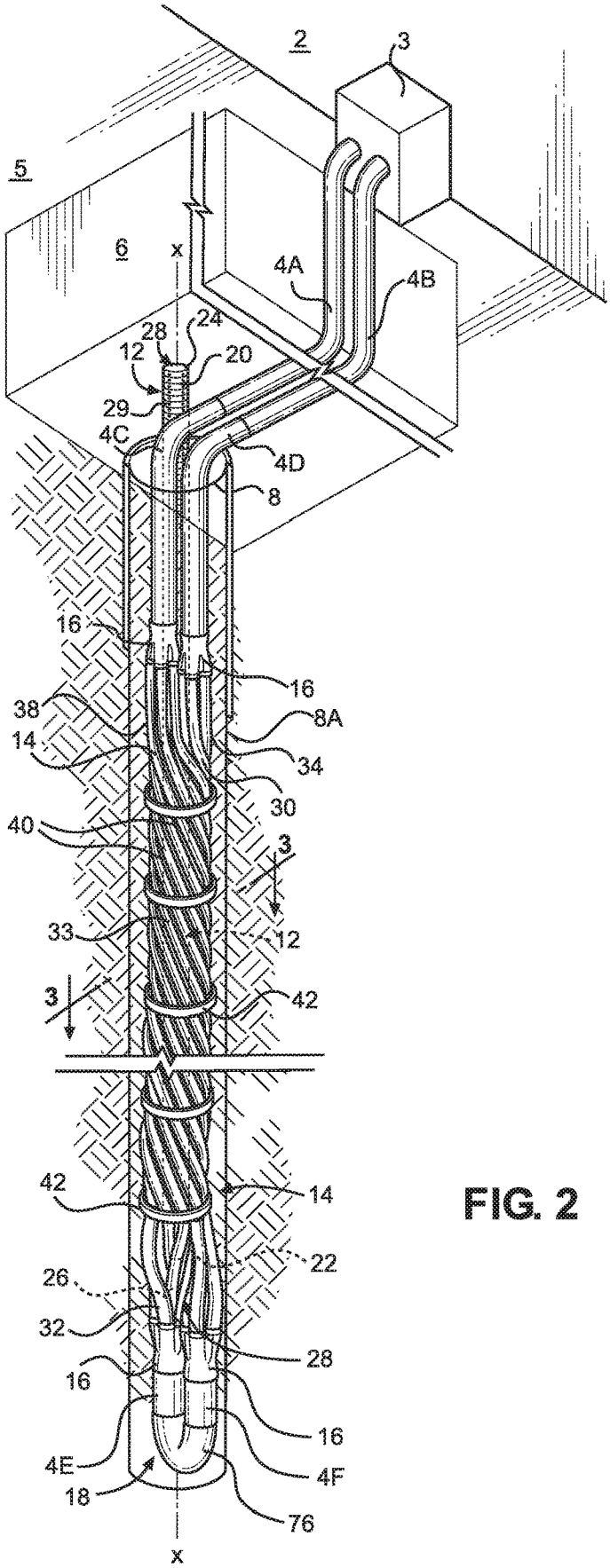
FIG. 2 is a side perspective partial cut-away view of the geothermal heat exchange apparatus of the present disclosure positioned in a bore hole that includes a fitting positioned below grade and in the bore hole and an extension of primary pipe extending from the fitting from the bore hole.

Referring initially to FIG. 2, geothermal heat exchange apparatus 10 has a tubular shaped overall structure defined by the combination of a central conduit 12 and a helical arrangement of the plurality of pipes 14 around central conduit 12. The geothermal heat exchange apparatus 10 includes the central conduit 12, plurality of pipes 14, at least one fitting 16 and a joint 18. The plurality of pipes 14 are twisted onto central conduit 12 in the helical arrangement for the exchange of heat. The at least one first fitting 16 connects to the plurality of pipes 14 and to at least two primary pipes 4A and 4B. The at least two primary pipes 4A and 4B are connected to at least one fitting 16 for fluid communication with heat pump 3. Joint 18 connects the plurality of pipes 14 to form a continuous loop for geothermal heat exchange. Geothermal heat exchange apparatus 10 or apparatus 10 defines a first longitudinal axis-X aligned with the centerline of central conduit 12.

Figure 3:
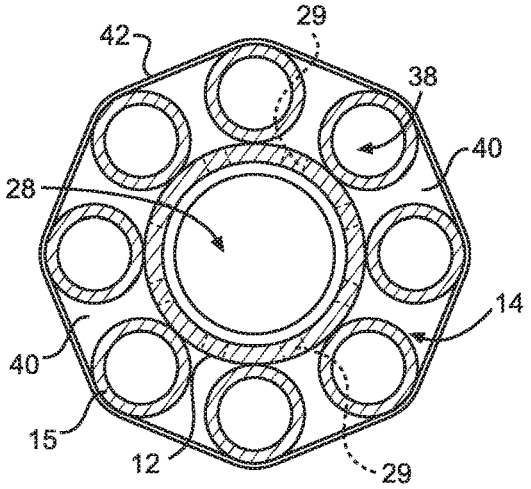
FIG. 3 is an idealized top view taken along lines 3-3 of geothermal heat exchange apparatus of FIG. 2.

As shown in FIGS. 2 and 3, central conduit 12 is a standard tubular conduit. Central conduit 12 or conduit 12 has a flexible structure that includes a first end portion 20 and an opposed second end portion 22. First end portion 20 defines a first terminal end 24 and second end portion 22 defines a second terminal end 26. The first terminal end 24 and second terminal end 26 define an aperture 28 that is a through hole that extends the length of central conduit 12. In one preferred embodiment, the dimensions of central conduit 12 include an inside diameter of approximately one and nine-tenths (1.9) inches, outside diameter of approximately two and four-tenths (2.4) inches and a wall thickness of approximately six hundred twenty five thousandths (1/16th or 0.0625) inches.

Central conduit 12 preferably has corrugated tubular walls that enhance the ability of central conduit to flex and form a circular or coiled shape. It is understood that the dimensions of the central conduit can vary depending upon the intended geothermal heat exchange application. The tubular wall of central conduit 12 can be solid or include a plurality of apertures 29. The shape of apertures 29 is shown as being circular, but it is understood that apertures 29 can have any shape and/or directional alignment suitable for facilitating the flow of a material such as grout from conduit 12 through apertures 29. The central conduit 12 is not in fluid communication with the plurality of pipes, The plurality of pipes 14 includes a first end portion 30, an opposed second end portion 32 and a central portion 33. The first end portion 30 of the plurality of pipes when positioned in bore hole 8 is below grade 5, the center portion includes the helical twisting arrangement and the second end portion 32 is in proximity to the terminal end of the bore hole 8.

Each pipe 15 of the plurality of pipes 14 has a flexible tubular structure that includes a first end portion 30 and an opposed second end portion 32. First end portion 30 includes a first terminal end 34 and second end portion 32 includes a second terminal end 36. The first terminal end 34 and second terminal end 36 define an aperture 38 that is a through hole that extends the length of each pipe 15. The diameter of aperture 38 of pipe 15 can vary depending upon the intended heat exchange application. In one preferred embodiment, individual pipes 15 of the plurality pipes 14 are standard ¾ or 0.75 inch inside diameter pipes 15 with a standard wall thickness of approximately 0.078 inch. The inside diameter and wall thickness of each pipe 15 of the plurality of pipes 14 is varied to accommodate the liquid flow and/or heat exchange demand for a given application. Primary pipe 4 preferably has an interior diameter of one and one-quarter (1.25) inches, but it is understood that the diameters of pipes 15 and primary pipe 4 can vary depending upon the application of geothermal heat exchange apparatus 10.

Geothermal heat exchange apparatus 10 is structured for positioning in a bore hole 8. The diameter and length of bore hole 8 and apparatus 10 can vary depending upon its intended application for heat exchange. In this one preferred embodiment, bore hole 8 has a six (6) inch diameter and apparatus 10 includes eight (8) pipes 15 that are wound around conduit 12 in the helical arrangement. The function of the helical arrangement of the eight (8) pipes 15 can vary, but the plurality of pipes 14 typically includes four (4) supply pipes 15 and four (4) return pipes 15. One common length of apparatus 10 is approximately 300 feet.

The materials of construction of the plurality of pipes 14 and fluid flow therein are controlled by local ordinances, building codes and environmental laws. In this preferred embodiment, the plurality of pipes 14 is made from a high-density polyethylene (HDPE) material. It is understood that the plurality of pipes 14 can be made from other materials that satisfy the local ordinances, building codes and environmental laws of the different legal jurisdictions.

Each pipe 15 of the plurality of pipes 14 is twisted onto and around the central conduit or conduit 12 in a parallel, spaced and twisted arrangement. Twisted onto as defined herein includes positioning the plurality of pipes 14 in direct contact with central conduit 12 in a helical arrangement. In the preferred embodiment the plurality of pipes 14 is positioned in an approximately parallel helical arrangement around the central conduit 12. Each pipe 15 of the plurality of pipes 14 is fixed in position in direct contact with central conduit 12 and has a space or a gap 40 between pipes 15. Each pipe 15 of the plurality of pipes 14 is positioned in approximate fixed spaced separation on central conduit 12 relative to the adjacent pipe 15 of the plurality of pipes 14. Individual pipes 15 of the plurality of pipes 14 can vary in their respective inside diameters, their length, the quantity of pipes 15 in the plurality of pipes 14 and the arrangement of pipes 15 on central conduit 12 depending upon the intended application of geothermal heat exchange apparatus 10. For example, in one preferred embodiment, plurality of pipes 14 includes a total of eight (8) pipes 15 in a twisted arrangement around the conduit 12. While this embodiment as shown includes four (4) pipes 15 that are supply pipes and four (4) pipes 15 that are return pipes, alternative embodiments of apparatus 10 can include two (2) pairs of pipes 15 with one (1) pair of pipes 15 being supply pipes 15 and the one (1) pair of pipes 15 being return pipes 15 or six (6) supply pipes 15 and six (6) return pipes 15.

The first end portion 30 and the second end portion 32 of the plurality of pipes 14 on central conduit 12 include a transition from the helical arrangement to a straight alignment with the central conduit and axis-X. The length of the straight alignment of the plurality of pipes 14 in first end portion 30 and second end portion 32 can vary, but is preferably three (3) to four (4) feet due primarily to the stiffness of pipes 15 and due to the straight length of pipe required to properly fuse the fitting onto the pipes. A straight alignment with each pipe 15 into each fitting 16 and primary pipe 4A or 4B is required because of the dimensional, form and fit limitations necessitated by the positioning of fittings 16 on conduit 12 that will be located in the six (6) inch diameter bore hole 8. The straight alignments of pipe 15, fitting 16, joint 18 and primary pipe 4 also make a less complex and more reliable connection.

Figure 4:
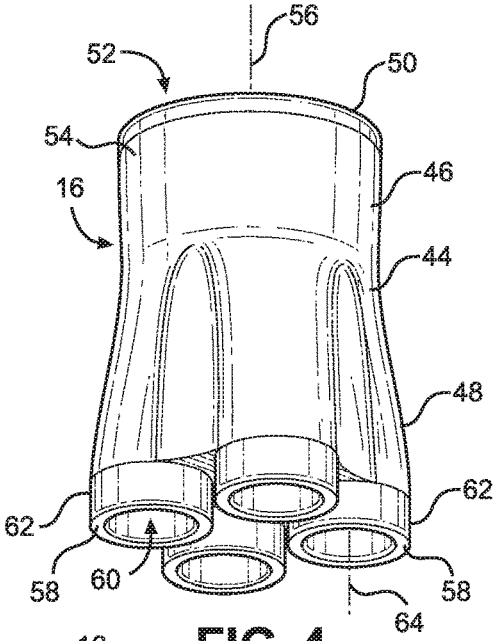
FIG. 4 is a side and second end portion perspective view of the fitting of the geothermal heat exchange apparatus of FIG. 2.

Referring now to FIG. 4, fitting 16 is a non-standard and unique manifold connector specifically dimensioned for positioning in bore hole 8 (See FIG. 2). In this one preferred embodiment, fitting 16 is a four (4) to one (1) manifold connector. Fitting 16 includes a housing 44, a first end portion 46 and a second end portion 48 that is opposed to the first end portion 46. First end portion 46 has a first terminal end 50 and first terminal end 50 defines a first aperture 52. Tubular wall 54 defines a center 56 of first aperture 52. Second end portion 48 includes a plurality of second terminal ends 58 that define a plurality of second apertures 60. Second end portion 48 preferably includes a plurality of short tubular extensions 62 that extend as cantilevered tubes from housing 44 to second terminal ends 58. Each second apertures 60 defined in second terminal ends 58 extends through tubular extension 62 and is in fluid communication with first aperture 52. Each second aperture 60 is circular and defines a center 64.

Figure 5:
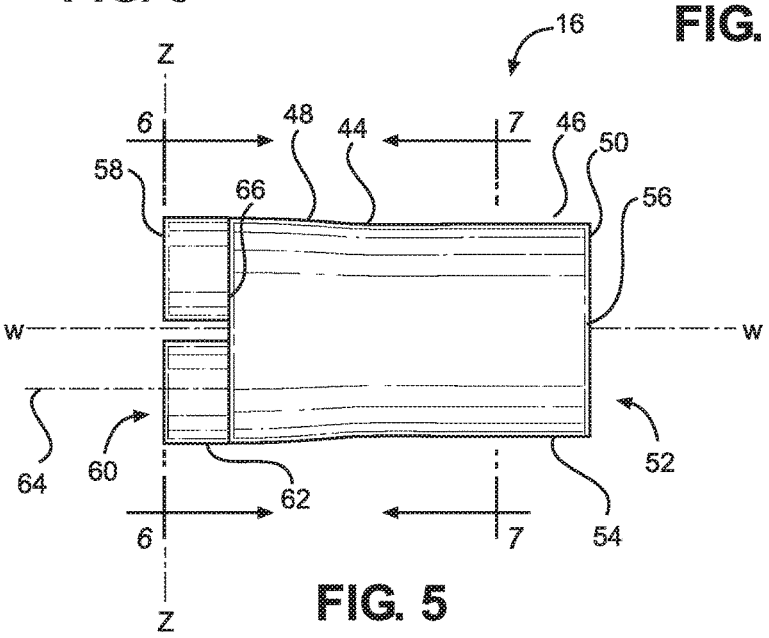
FIG. 5 is a side view of the fitting of the geothermal heat exchange apparatus of FIG. 2.

As shown in FIG. 5, first end portion 46 includes tubular wall 54 and that defines first aperture 52. The center 56 of first aperture 52 defines a centerline of fitting 16 housing 44 and also defines an axis-W. An axis-Z is perpendicular to, intersects axis-W and is aligned with the plurality of second terminal ends 58. Tubular extensions 62 have an abbreviated length beyond housing 44. Centers 64 that are also centerlines of tubular extensions 62 are aligned with axis-W.

Figure 6:
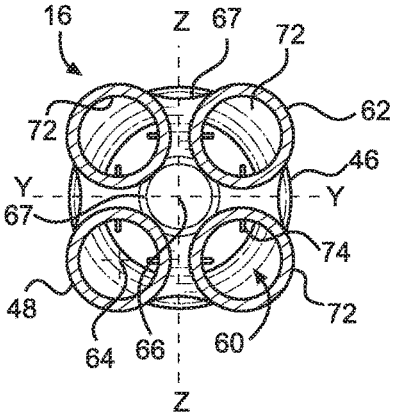
FIG. 6 is a view taken along lines 6-6 of the second end portion of the fitting of the geothermal heat exchange apparatus of FIG. 2.

Referring now to FIGS. 5 and 6, an axis-Y is aligned with the plurality of second terminal ends 58 and is perpendicular to axis-Z. A plane Y-Z is defined by the intersection of the axis-Y and axis-Z. Plane Y-Z is aligned with the plurality of second terminal ends 58 and is parallel to the first terminal end 50. Axis-W extends through the first end portion 46, center 56 of first aperture 52, through housing 44 and an axial center 66 of second end portion 48. Tubular extensions 62, apertures 60 and centers 64 are aligned with axis-W. Plane Y-Z is perpendicular to axis-W.

Second end portion 48 tubular extensions 62 are connected to their respective adjacent tubular extensions 62 by structural walls 67. In this preferred embodiment each tubular extension 62 is connected by two structural walls 67 that include outer structural walls 67 and the inner structural wall 67. The outer structural walls 67 are contiguous with housing 44 and extend between adjacent tubular extensions 62. The inner structural walls 67 connect adjacent tubular extensions 62 in a region in proximity to axial center 66 and/or axis-W.

As shown in FIGS. 4-6 in this one preferred embodiment, fitting 16 is a four (4) to one (1) manifold connector that includes four (4) pipes 15 to one (1) primary pipe 4 (See FIG. 2). The four (4) second apertures 60 each have centers 64 that define the corners of a square arrangement of second apertures 60 and tubular extensions 62. The width between the outer edges of two adjacent second tubular extensions 62 of the second end portion 48 is greater than the outside diameter of first tubular wall 54 of first end portion 46.

Figure 7:
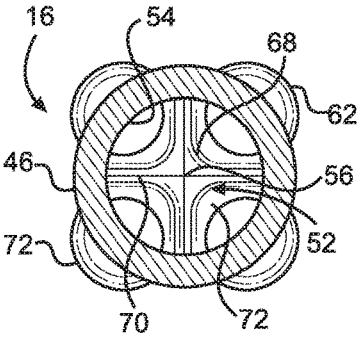
FIG. 7 is a view taken along section lines 7-7 of the first end portion of the first end portion of the fitting of the geothermal heat exchange apparatus of FIG. 2.

Referring now to FIG. 7 and continuing with the above preferred embodiment of fitting 16, crossed pair of support walls 68 are positioned centrally in housing 44 have tapered terminal edges 70. Crossed pair of support walls 68 or support walls 68 form a part of the inner surface of second tubular walls 72. The intersection of the support walls 68 is axial center 66. The outer surface of each second tubular wall 72 second end portion 48 extends outside of the diameter of the outer surface of first tubular wall 54 first end portion 46. As shown in FIGS. 4-7, the preferred embodiment of fitting 16 includes second apertures 60 and the initial portions of tubular walls 72 in proximity to terminal end 58 are aligned with and/or parallel to axis-W. After the initial length of second tubular walls 72, the angular alignment of second tubular walls 72 are directed within housing 44 from the centerline 64 of second aperture parallel to axis-W in inward directions towards axis-W at an angle of approximately eight and four tenths degree (8.4°). This relatively shallow angle defines a point of convergence of the four (4) apertures 60 that extends beyond the first terminal end 50 of fitting 16 and into the interior tubular wall of the connecting primary pipe 4. The interior of housing 44 is structured to provide smooth fluid flow in both directions aligned with axis-W. For example, the support walls 68 that diverge the fluid flow from or merge the fluid flow into first aperture 52 include tapered edges 70 that are directed towards first terminal end 50 and the intersection of the support walls 68 has an approximate conical surface. Similarly, pairs of thin ridges 74 are located in proximity to and on opposing sides of the connection of each support wall 68 to the inner surface of tubular walls 72. The pairs of thin ridges 74 begin in proximity to the start of the approximately eight and four tenths degree (8.4°) degree angling of second tubular walls 72 and extend past the intersection of each support wall 68 on the inner surface of each tubular wall 72. Each pair of ridges 74 is aligned with the center 64 of their respective second apertures 60 and second tubular walls 72. Ridges 74 assist in maintaining laminar fluid flow through the diverging and merging of fluid flow in housing 44. Fitting 16, in this preferred embodiment, is made from a high-density polyethylene (HDPE) material. It is understood that the fitting 16 can be made from other materials that satisfy the local ordinances, building codes and environmental laws of the different legal jurisdictions where apparatus 10 is installed.

It is understood that while fitting 16 is shown as four (4) to one (1) manifold connector, fitting 16 can vary the external shape of housing 44 and have increased numbers of second apertures 60 and first apertures 52 for different applications. For example, fitting 16 second end portion 48 can include at least four apertures 60 and first end portion 46 can include two (2) first apertures 52 for connection to two (2) primary pipes 4A for supply and 4B for return.

The connections between the plurality of pipes 14 first terminal ends 24 and second terminal ends 26, fitting 16, primary pipes 4 and joint 18 are preferably by a hot melt butt joint type connection that is widely considered to be stable in connection qualities. Other method of connection, such as socket-type electric hot melt connection, for example. The above described hot melt butt joint can be further augmented in poor geological environments with additional layers of heat shrink material such as a tape as a sealing layer to further strengthen the connection.

Figure 8:
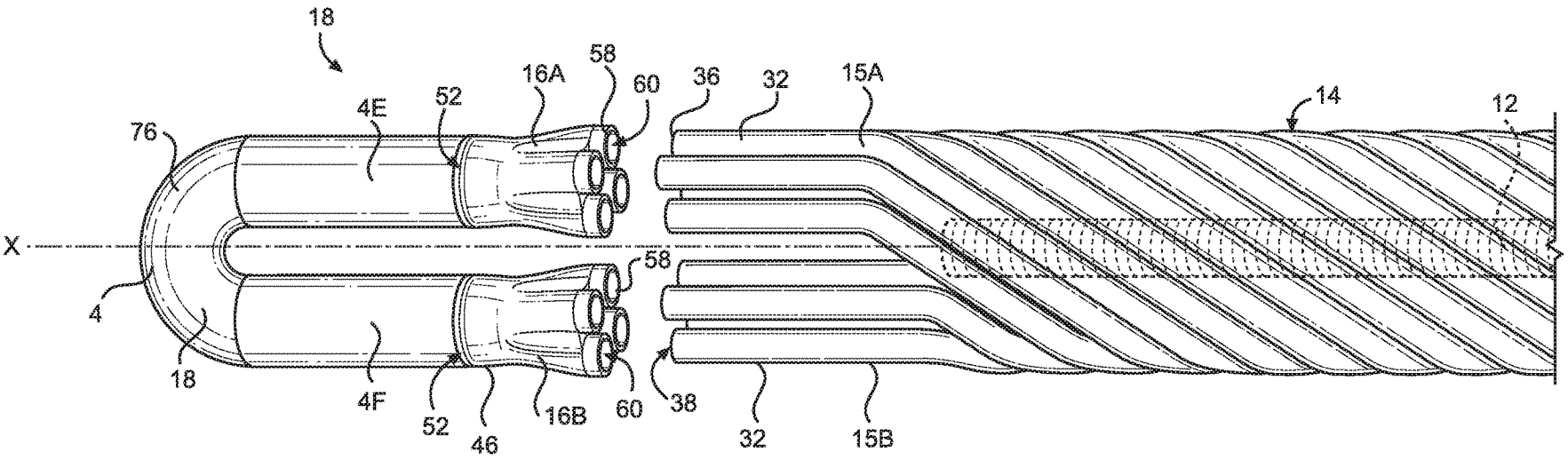
FIG. 8 is an idealized side view of the second end portion of the plurality of pipes of the geothermal heat exchange apparatus of FIG. 2 and a side and second end portion perspective view of the second fittings, lengths of primary pipes and a joint, the second end portion of the pipes aligned for connection with the second fittings of the joint.

As shown in FIG. 8, in one preferred embodiment, the plurality of pipes 14 include a plurality of supply pipes 15A and a plurality of return pipes 15B. As shown for this embodiment, the second end portion 32 of four (4) supply pipes 15A and second end portion 32 of four (4) return pipes 15B respectively connect to the four (4) second terminal ends 58 on identical supply fitting 14A and return fitting 14B. The first apertures 52 of first end portions 46 of supply fitting 14A and return fitting 14B are preferably connected directly with a joint 18 or indirectly through sub-assemblies of joint 18 such as lengths of primary pipes 4E and 4F and fittings 16, for example. In this embodiment, fittings 16A and 16B are connected to lengths of primary pipes 4E and 4F, respectively. Standard U-bend 76 is sized for connection with primary pipes 4E and 4F. Primary pipe 4E connects to the first aperture 52 of supply fitting 16A and primary pipe 4F connects to the first aperture 52 of return fitting 16B. Primary pipes 4E and 4F then connect to the apertures defined in U-bend 76. This embodiment provides an advantageous use of fittings 16 for connection with primary pipe 4 as part of first end portion 30 of plurality of pipes 14 (See FIG. 2) as well as in joint 18 that connects to second end portion 32 of plurality of pipes 14.

Figure 9:
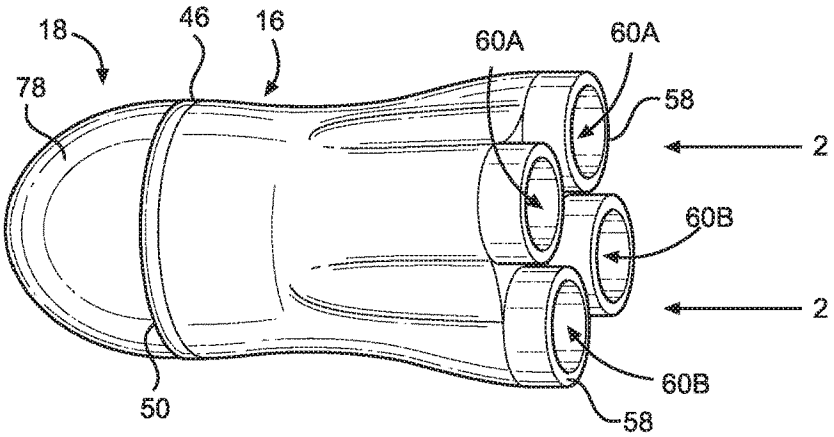
FIG. 9 is a side and second end portion perspective view of an alternative embodiment of the joint of FIG. 2 with a cap connected to the first end portion of the fitting of the joint.
Figure 10:
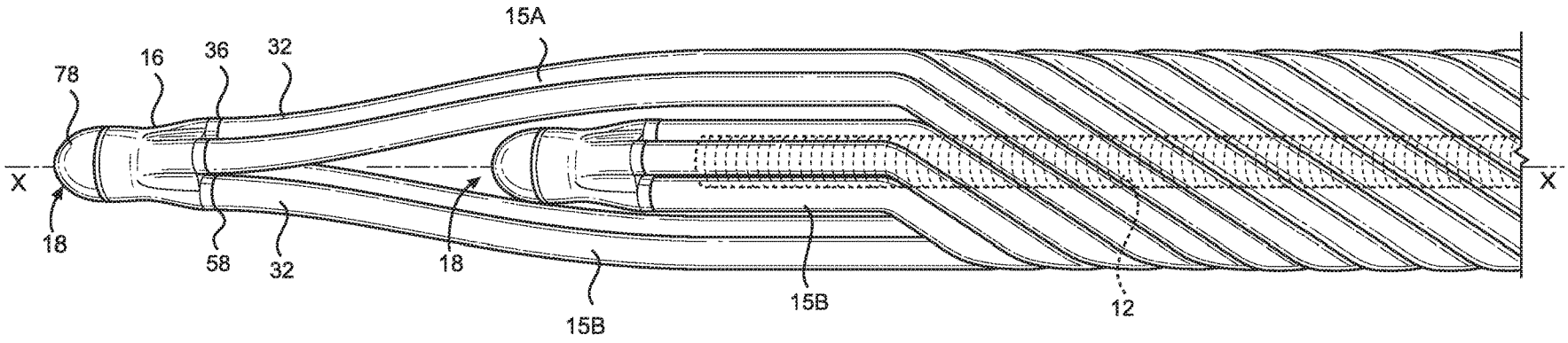
FIG. 10 is an idealized side view of the second end portion of the plurality of pipes and a side and second end portion perspective view of the joint of FIG. 9, the joint including two second fittings connected to the second terminal ends of the plurality of pipes and the two fittings staggered along axis-X.
Figure 11:
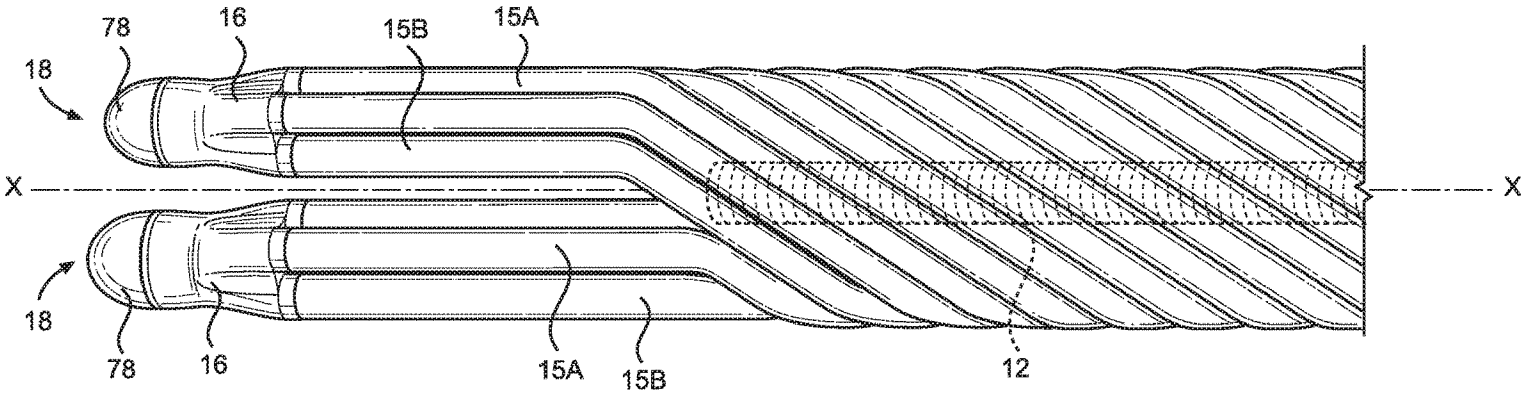
FIG. 11 is an idealized side view of the second end portion of the plurality of pipes and a side and perspective view of the joint of FIG. 9, the joint including two second fittings connected to the second terminal ends of the plurality of pipes and the two fittings positioned in tandem in a side by side on opposing sides of axis-X.

Referring now to FIGS. 9-11, in an alternative embodiment, each fitting 16 uses two (2) second apertures 60 for supply and two (2) second apertures 60 for return. First end portion 46 includes a cap 78 that secures to first terminal end 50 and closes first aperture 52 (See FIG. 7) turning fitting 16 into a variation of a U-bend connector. The two supply pipes 15A and two return pipes 15B per fitting 16 can be operationally employed to stagger fittings 16 along axis-X or alternatively in tandem or side by side on opposing sides of axis-X.

Figure 12:
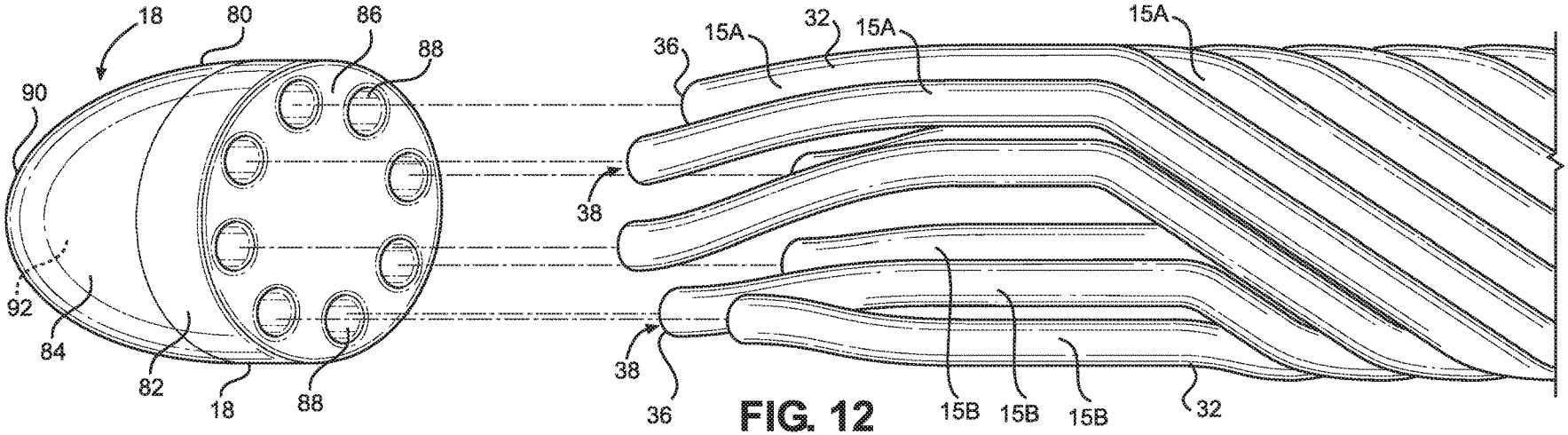
FIG. 12 is an idealized side and second end portion perspective view of an alternative embodiment of the joint of the geothermal heat exchange apparatus of FIG. 2 showing the connection of the terminal end of the joint with the second terminal ends of each pipe of the plurality of pipes.
Figure 14:
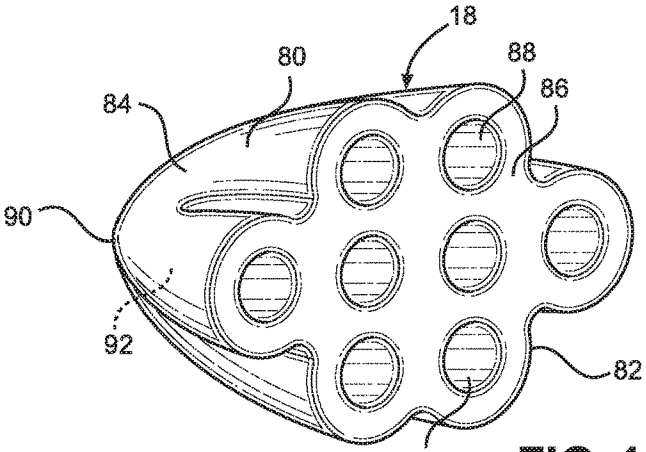
FIG. 14 is an alternative embodiment of the joint of FIG. 12 in which the apertures that connect to the second terminal ends of each pipe of the plurality of pipes are positioned in three rows.
Figure 13:
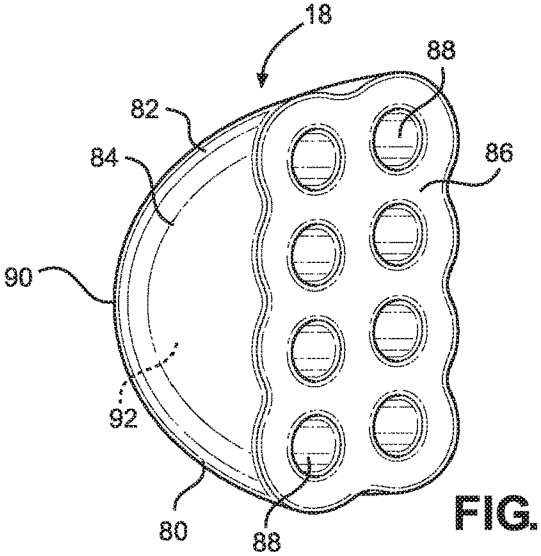
FIG. 13 is an alternative embodiment of the joint of FIG. 12 in which the apertures that connect to the second terminal ends of each pipe of the plurality of pipes are positioned in two rows.
Figure 15:
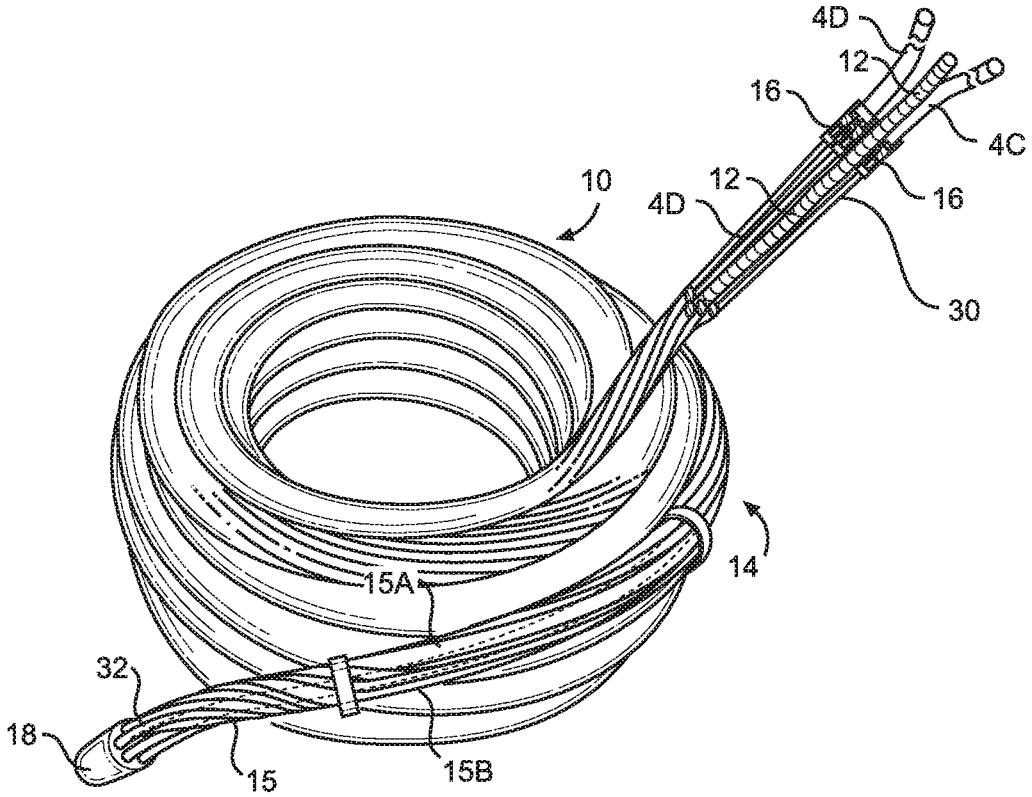
FIG. 15 is a top and side perspective view of the geothermal heat exchange apparatus of FIG. 2 coiled into a roll, the view further including a partial cut-away of the first end portion of the plurality of pipes showing the interior of the fittings and the connections to the primary pipes.

As shown in FIGS. 12-14, in another alternative embodiment, each pipe 15 connects to a single joint 18. This embodiment has the advantage that the second terminal ends 36 of pipes 15 cannot be connected to the wrong aperture 38 in fitting 16 or joint 18 or the wrong fitting 16. Joint 18 includes a housing 80, first end portion 82 and an opposed second end portion 84. First end portion 82 includes a first terminal end 86 and first terminal end 86 defines a plurality of apertures 88. The second terminal ends 36 of pipes 15 connect to the apertures 88 in terminal end 86. Apertures 92 feed into a common reservoir 90 that can vary in capacity depending upon the intended application. Joint 18 in this embodiment can have any arrangement of apertures 88 as long as apertures 88 are all connected to reservoir 90. Referring now to FIG. 15, each component of the geothermal heat exchange apparatus 10 that includes central conduit 12, plurality of pipes 14, fitting 16 and joint 18 is structured, connected and inter-related for flexibility. Thus, the fully assembled apparatus 10 can be coiled into a stack of coils for efficient storage and/or transportation. Upon arrival at an installation site, apparatus 10 can also be readily uncoiled into a linear alignment for installation down borehole 8. Apparatus 10 primary pipes 4C and 4D can be connected to the primary pipes 4A and 4B that connect to the heat pump 3 before or after installation in bore hole 8 (See FIG. 2).

Figure 16:
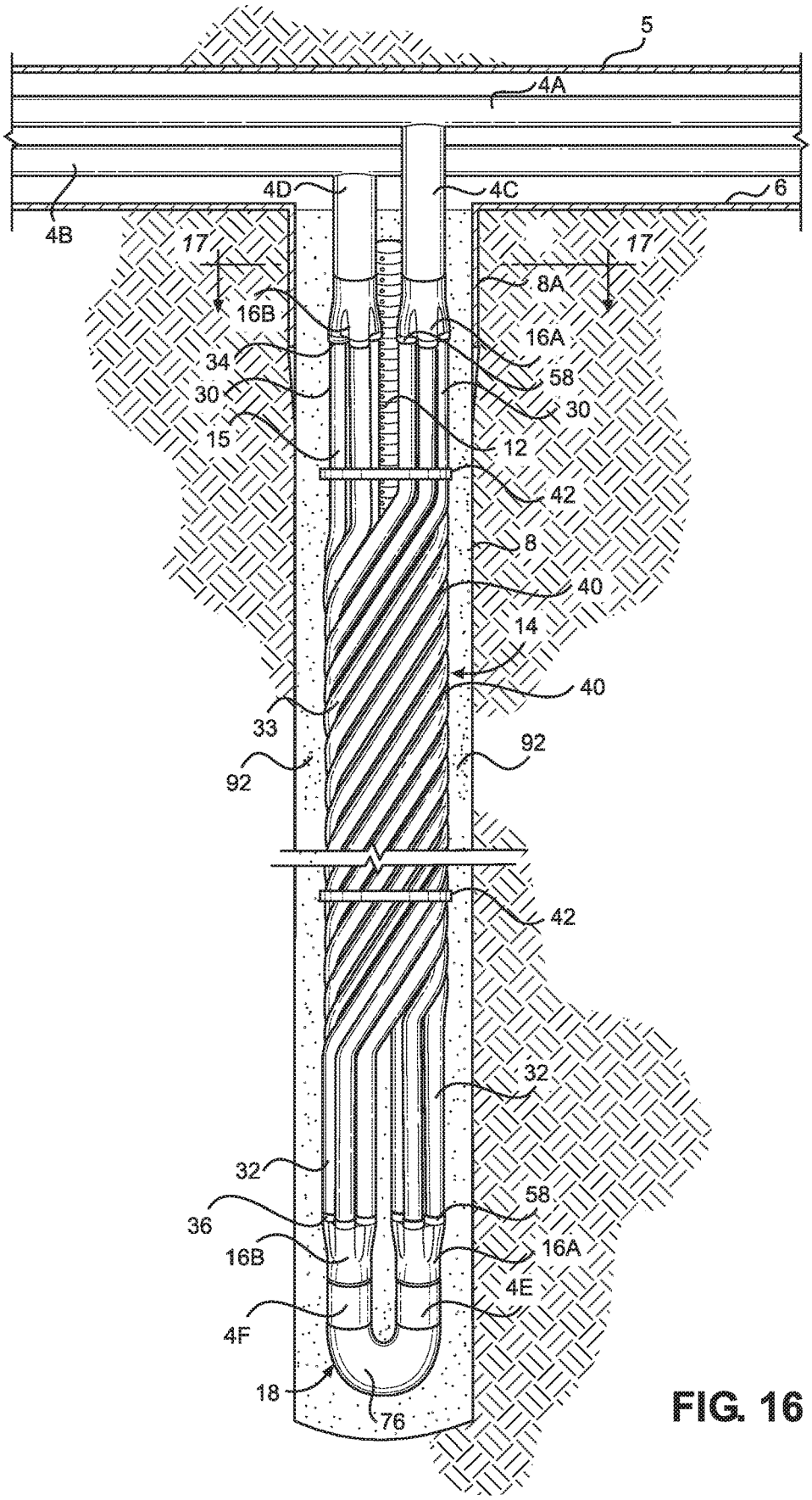
FIG. 16 is an idealized cross sectional view of the bore hole showing geothermal heat exchange apparatus of FIG. 2 in the bore hole showing the first end portion and second portion of the plurality of pipes transitioning from the helical arrangement to an arrangement parallel to the axis-X and the connections of the fittings to the plurality of pipes and the primary pipes.

As shown in FIGS. 2 and 16, geothermal heat exchange apparatus 10 is installed in bore hole 8 for operational use with primary pipes 4C and 4D connecting to primary pipe 4A and 4B, respectively. Central conduit 12 has been used as a tremie type pipe for the insertion of grout 92 or other related compounds to backfill bore hole 8. Grout 92 permeates the bore hole 8 from the bottom up as well as through apertures 29 of central conduit 12.

Figure 17:
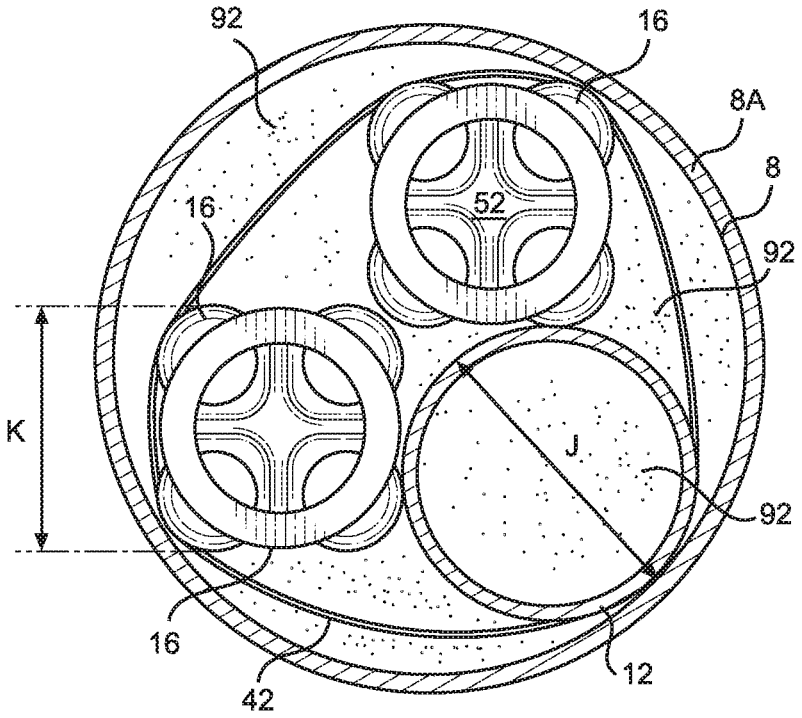
FIG. 17 is a cross-sectional view taken along lines 17-17 showing the compact arrangement of the two fittings and central conduit in the bore hole.

Referring now to FIG. 17, the dimensions of the fittings 16 and central conduit 12 require a tight fit in bore hole 8. Fittings 16 are preferably located between (2) and three (3) feet below trench 6 and within the length of the casing 8A of bore hole 8. In this one preferred embodiment of a four to one (4 to 1) fitting 16 manifold connector in a six (6) inch bore hole, the dimensions of the outside diameter J of central conduit 12 is approximately two and four tenths inches (2.4) and the width dimension of fitting 16 is approximately two and three tenths (2.3) inches and a length of approximately four and seventy-five one-hundredth (4.75) inches. In an ideal arrangement the sum of the diameter of central conduit 12 and width of fitting 16 is approximately 4.7 inches. In the worst case, the diagonal distance between diagonally opposed second apertures 60 is approximately two and seventy-five one hundredth (2.75) inches or a total of approximately five and fifteen hundredth (5.15) inches that readily fits in the six (6) inch diameter bore hole.

As shown in FIGS. 2 and 16, geothermal heat exchange apparatus 10 has been extended from the coiled position to a linear position in an approximately vertical borehole 8 in ground 6. It is understood that borehole 8 is not required to be vertical and can be angled from the vertical. Once positioned in borehole 8, an external source of grout is used to supply grout 92 into central conduit 12 aperture 28 in first end portion 20. Grout 92 is preferably pumped under pressure down conduit 12 and out through aperture 28 in the second end portion 18 and apertures 29 in the tubular wall of conduit 12. Grout 92 surrounds the geothermal heat exchange apparatus 10 in borehole 6 through the primary loading of the grout at the bottom of the borehole and filling the borehole 6 vertically upward as is common practice. In addition, grout 92 advantageously passes through apertures 38 in the tubular wall of conduit 12 in order to provide grout 40 transverse to the longitudinal axis in order to properly fill the spaces 32 between the pipes 15 of the plurality of pipes 14 in approximately fixed spaced separation. As required for a given application, bands 34 can be applied around the plurality of pipes 14.

The relatively thin walled structure of central conduit 12 and each pipe 15 of the plurality of pipes 14 of geothermal heat exchange apparatus 10 that facilitates coiling also advantageously provides less thermal resistivity and correspondingly better heat transfer when the geothermal heat exchange apparatus 10 is installed in the earth or ground 6.

Geothermal heating exchange apparatus 10 has an advantageous level of heat transfer due to the helical twist in the plurality of pipes 14 and the creation of secondary effects in the fluid flow in the plurality of pipes 14. Secondary effects occur in curved pipes 15 as the laminate flow against the boundary layer on the inside of each pipe 15 becomes a cross flow between the inner and outer pressure gradients experienced by the heat exchange fluid in the plurality of pipes 14. The secondary flow results in elevated levels of heat transfer at relatively low Reynolds numbers in the range of 1,000 or less without the high turbulence and greater pump pressure demands required by straight pipes to achieve the approximately same level of heat transfer at Reynolds number in the range of approximately 2,500 to approximately 3,000. Further, the combination of multiple relatively small diameter plurality of pipes 14 provides for increased surface area for heat transfer.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. While the present disclosure is described in terms of a series of embodiments, the present disclosure can combine one or more novel features of the different embodiments. The specification and drawings are accordingly to be regarded in an illustrative manner rather than a restrictive sense.

What is claimed is:

1. A pre-assembled geothermal heat exchange apparatus adapted for installation in a borehole, the pre-assembled geothermal heat exchange apparatus includes a plurality of pipes in a twisted arrangement around a central conduit for geothermal heat exchange, the pre-assembled geothermal heat exchange apparatus comprises:

the central conduit has a first end portion, a first terminal end, a second end portion and a second terminal end, the first end portion includes the first terminal end, the second end portion is opposed to the first end portion and includes the second terminal end, a center portion of the central conduit is continuous with and in fluid communication with the first end portion and the second end portion, the central conduit is flexible, the central conduit defines a through hole that extends the length between the first terminal end and the second terminal end, each pipe of the plurality of pipes has a first end portion, a center portion and a second end portion, the first end portion of each pipe is aligned with the central conduit and includes a first terminal end, the center portion of each pipe is in a helical arrangement around the central conduit, the center portion of each pipe is in fluid communication with the first end portion and the second end portion of the plurality of pipes, the second end portion is aligned with the central conduit and includes a second terminal end, each pipe of the plurality of pipes defines an aperture that extends the length between the first terminal end and the second terminal end, each pipe of the plurality of pipes is flexible, the plurality of pipes is in direct contact with the central conduit, the plurality of pipes is bound to the central conduit, the plurality of pipes includes at least two pipes that are supply pipes and at least two pipes that are return pipes, each pipe of the plurality of pipes has a diameter that is less than a diameter of the central conduit, the central conduit is not in fluid communication with the plurality of pipes, at least four fittings, each fining is a manifold connector, each fining has a first end portion and the first end portion includes a first terminal end, the first terminal end defines a first aperture, each fitting has a second end portion, the second end portion is opposed to the first end portion and the second end portion includes at least two second terminal ends and each second terminal end defines a second aperture, the first terminal ends of the at least four fittings are adapted to connect to the primary pipes, the second terminal ends of one fitting of the two fittings connect to the first terminal ends of the at least two supply pipes of the plurality of pipes and the second terminal ends of the other fitting of the two fittings connect to the first terminal ends of the at least two return pipes of the plurality of pipes, the at least two second apertures and the first apertures of the two fittings are aligned with the central conduit and are in fluid communication, the two fittings are in direct contact with, connected to and fixed in position on the first end portion of the central conduit, and a joint, the joint includes two fittings and a U-bend, the at least two second terminal ends of a first fitting of the two fittings of the joint are connected to the at least two pipes of the plurality of pipes that are supply pipes and the first terminal end of the first fitting is connected to the U-bend, the at least two terminal ends of a second fining of the two fittings of the joint are connected to the at least two pipes of the plurality of pipes that are return pipes and the first terminal end of the second fitting is connected to the U-bend, the joint provides fluid communication from the at least two pipes that are supply pipes of the plurality of pipes to the at least two pipes that are return pipes of the plurality of pipes, the pre-assembled geothermal heat exchange apparatus adapted for installation in the borehole.

2. The geothermal heat exchange apparatus of claim 1 wherein each fitting is identical.

3. The geothermal heat exchange apparatus of claim 1 wherein one fitting is a supply fitting, the supply fitting is adapted to connect to and be in fluid communication with one primary pipe that is the supply pipe and the supply fitting is connected to at least two pipes of the plurality of pipes that are supply pipes, one fitting is a return fitting, the return fitting is adapted to connect to and be in fluid communication with one primary pipe that is the return pipe and the return fitting is connected to at least two pipes of the plurality of pipes that are return pipes, the supply fitting and return fitting are fixed to the first end portion of the central conduit and configured for positioning in bore hole.

4. The geothermal heat exchange apparatus of claim 1 wherein the first terminal end of each fitting of the joint connects to a length of pipe and each length of pipe connects to one of the terminal ends of the U-bend, the U-bend connects the at least two pipes of the plurality of pipes that are supply pipes to the at least two plurality of pipes that are return pipes.

5. The geothermal heat exchange apparatus of claim 1 wherein the joint includes at least two joints and the joints are positioned in an elongate staggered arrangement along a central axis of the geothermal heat exchange apparatus.

6. The geothermal heat exchange apparatus of claim 1 wherein the two fittings of the joint are positioned in a tandem arrangement on opposing sides of a central axis of the geothermal heat exchange apparatus.

7. The geothermal heat exchange apparatus of claim 1 wherein the joint includes a common reservoir.

8. The geothermal heat exchange apparatus of claim 1 wherein the first end portion of the conduit extends beyond the two finings fixed to the first end portion of the central conduit.

9. The geothermal heat exchange apparatus of claim 1 wherein the joint includes at least:

two joints, the fittings of each joint include second end portions that connect to at least two pipes of the plurality of pipes that are supply pipes and at least two pipes of the plurality of pipes that are return pipes, each of the first end portions of the fittings connect to the U-bend, the at least two joints are in a tandem arrangement on opposing sides of a central axis of the geothermal heat exchange apparatus.

10. The geothermal heat exchange apparatus of claim 1, wherein the joint comprises one or more joints, wherein the two fittings of each joint include a different number of second apertures than the number of second apertures of the supply fitting and the return fitting.

* * * * *